US006585213B1

(12) United States Patent
Olivier

(10) Patent No.: US 6,585,213 B1
(45) Date of Patent: Jul. 1, 2003

(54) ARTICLE OF FURNITURE FOOT ELEVATIONAL SPACER

(76) Inventor: Josua Olivier, P.O. Box 2195 Wingatepark, Pretoria (ZA)

( * ) Notice: Subject to any disclaimer, the term of this patent is extended or adjusted under 35 U.S.C. 154(b) by 0 days.

(21) Appl. No.: 09/435,061

(22) Filed: Oct. 25, 1999

Related U.S. Application Data

(60) Provisional application No. 60/105,979, filed on Oct. 28, 1998.

(51) Int. Cl.[7] ..... A47B 91/00
(52) U.S. Cl. ..... 248/346.11; 248/188.4
(58) Field of Search ..... 248/346.11, 188.4, 248/188.2

(56) References Cited

U.S. PATENT DOCUMENTS

| | | | | | |
|---|---|---|---|---|---|
| 824,525 | A | * | 6/1906 | Bonney | 248/188.4 |
| 5,628,484 | A | * | 5/1997 | Lechuga | 248/188.4 X |
| 5,743,506 | A | * | 4/1998 | Adams | 248/346.11 |
| 6,119,998 | A | * | 9/2000 | Anselmo | 248/346.11 |

FOREIGN PATENT DOCUMENTS

| | | | |
|---|---|---|---|
| DE | 3340132 | * | 5/1985 |
| FR | 2265314 | * | 10/1975 |
| GB | 2142230 | * | 1/1985 |
| ZA | 75-7749 | * | 12/1975 |
| ZA | 88-4295 | * | 6/1988 |

* cited by examiner

*Primary Examiner*—Ramon O. Ramirez

(57) ABSTRACT

An article of furniture foot elevational spacer in the form of a carpet pile shield (10) comprises a generally rectangularly shaped hollow dual sided foot support (12) and a spacer leg configuration constituting a plurality of legs formations as provided by legs (14) ending with spiked opposite ends (16). The legs (14) fit adjustably and removably along threaded apertures (18). The one end (16.1) of each leg (14) is more acute than the opposite end (16.2) to enable the shield (10) to accommodate two pile thicknesses. The upward facing parts of the legs (14) perform a boundary defining function in bordering the seating area (12.2) of the support (12) to constrain the foot (22) of an item resting on it, once in use. The support (12) is also fitted with a foot dismounting counteracting finger (24) fitting screw-fashion along a centrally located threaded aperture (26) in the support (12).

12 Claims, 2 Drawing Sheets

ARTICLE OF FURNITURE FOOT ELEVATIONAL SPACER

CROSS-REFERENCE TO RELATED APPLICATIONS

Not applicable

Figure 1:
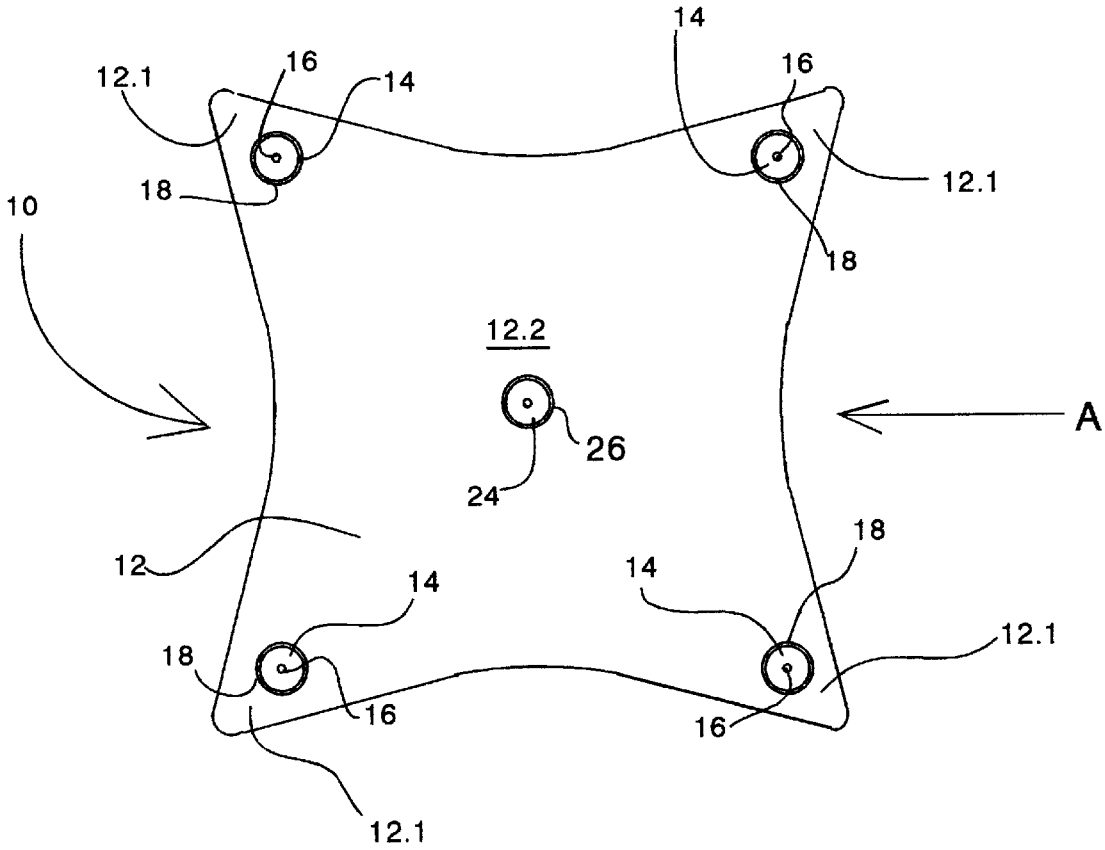

This application claim benefit to provisional application 60/105,979 Oct. 28, 1998.

BACKGROUND-FIELD OF THE INVENTION

This invention relates to an article of furniture foot elevational spacer for locating a foot of an article of furniture above a support base thereby to enable the desirable maintenance of an article of furniture fitted with a plurality of feet above such base by the use of an appropriate number of spacers.

BACKGROUND-DESCRIPTION OF PRIOR ART

The positions where the feet of an article of furniture rest onto a carpet normally become marked owing to becoming flattened with time. When such carpet locations become exposed it detrimentally affects the appearance of the carpet.

To overcome the problem elevational spacers presenting spacing formations extending from a support platform and passing into the pile of a carpet once in use have been developed. A spacer is thus located under each of the feet of an article of furniture which elevates the legs of the article above the pile of the carpet. The spacing formations pass inbetween the piles and urge against either the carpet backing or the base underneath such carpet when the formations are in the form of sharp spikes.

British patent number 2 142 230, French patent number 2 265 314, German patent number 3 340 132 and South African patent numbers 75/7749 and 88/4295 all show a variety of spike or prong configurations as extending from supports used to limit the substantially permanent indentation effect of a foot of an article of furniture on the pile of a carpet.

French patent number 2 265 314, British patent number 2 142 230 and South African patent number 88/4295 furthermore show some or other form of foot encapturing configuration to limit the possibility of lateral sliding of a foot located on such spacer resulting in its lateral sliding therefrom. British patent number 2 142 230, South African patent number 88/4295 and German patent number 3 340 132 also show that the spacer can be secured to the bottom of the foot of an article of furniture especially where the latter permits penetration by, for example, a screw.

None of the dicussed patents however make provision for accommodating a difference in leg length from time to time found in articles of furniture requiring the various legs to be maintained at spacings different from one another above a support surface, even though only marginally.

While the possibility of securing a spacer to the foot of an article of furniture is disclosed, in all cases this is for material where a permanent fixture is formed such as by way of a wood-screw.

A situation often found where the feet of articles of furniture are elevationally maintained above a carpet is that some of the feet are located off the carpet thus requiring spacing above a hard surface such as a tiled or wooden floor. The spiked or pronged ends of the legs or the like that are useful in limiting indentation of the pile of a carpet can in such case damage or mark the floor.

SUMMARY

In accordance with the present invention an article of furniture foot elevational spacer for, amongst others, protecting piles, as extending from a pile carrier, against compressive indentation as otherwise caused by one or more feet of an article of furniture bearing down onto such pile comprises a dual sided article of furniture foot support and legs extending from both sides of the support.

OBJECT AND ADVANTAGES

The objects and advantages of the present invention, amongst others, lie in providing a spacer that can accommodate various carpet pile thicknesses as well as a hard surface to cater for cases where furniture stand partly on a carpet and partly on a hard floor. The invention also provides for adjusment to accommodate different leg lengths.

The invention furthermore makes provision for counteracting lateral sliding of a foot when supported not only by bordering the zone onto which a foot is located but also by way of a central lateral movement limiting facility that need not be secured to the foot.

DRAWING FIGURES

Figure 2:
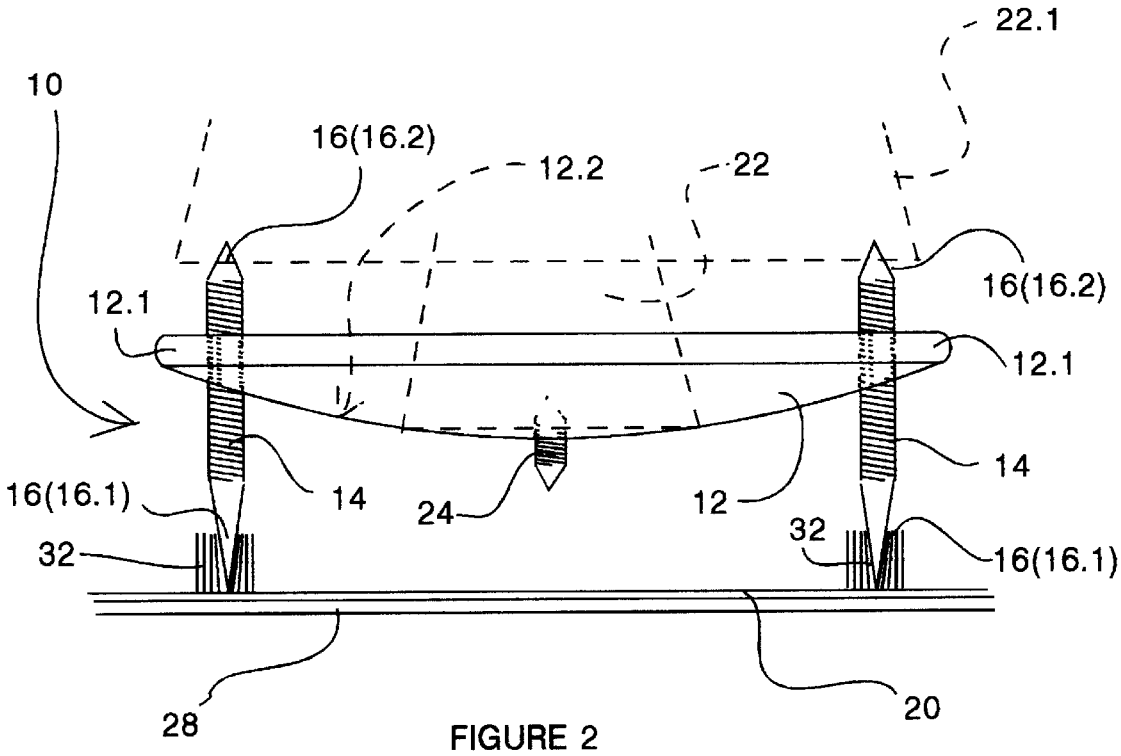
Figure 3:
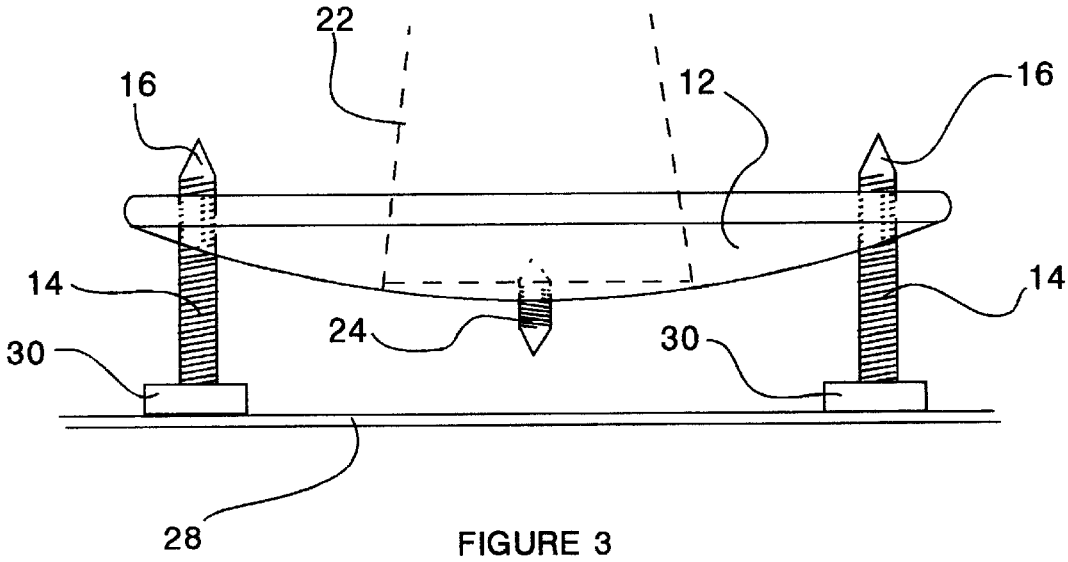

FIG. 1 shows one embodiment of an article of furniture foot elevational spacer in the form of a carpet pile shield according to the invention, in plan view, FIG. 2 shows the shield of FIG. 1 in side elevation along arrow A in FIG. 1, and FIG. 3 shows another embodiment of the article of furniture foot elevational spacer in a similar view as shown in FIG. 2 though with the legs presenting different end formations enabling its use both as carpet shield and as a hard support base elevational spacer.

Reference numerals in drawings

10 shield/spacer
12 foot support
14 leg
16 leg end
18 aperture
20 carpet pile backing
22 article of furniture foot
24 finger
26 finger aperture
28 floor
30 bund head
32 carpet pile DESCRIPTION—FIGS. 1 and 2—One embodiment of the invention Referring to FIGS. 1 and 2 of the drawings an article of furniture foot elevational spacer in the form of a carpet pile shield, according to the invention, is generally indicated by reference numeral 10.

The shield 10 comprises a generally rectangularly shaped dual sided foot support 12 extending in the form of a hollow sheet, and a spacer leg configuration constituting a plurality of leg formations as provided by legs 14 ending with spiked opposite ends 16.

The legs 14 are fully removably adjustably mounted to the support 12 by fitting along threaded apertures 18 located towards the apexes 12.1 of the support 12. The one end 16.1 of each leg 14 is more acute than the opposite end 16.2 to enable the shield 10 to accommodate two pile thicknesses. The legs 14 are naturally fitted to the support 12 with spiked ends of the same acuteness coinciding by facing the same direction. The difference in acuteness permits the desired selection depending on the thickness of the pile of a carpet as well as the ability to also penetrate the pile carrier or backing 20 of a carpet when such operative use is desired. The support 12 can thus bear down onto a base, such as a floor 28, onto which the carpet lies owing to the spiked ends 16.1 of the legs 14 penetrating the pile carrier or backing 20 of a carpet. Depending on the shape of the spiked end selected and the strength of the backing 20 the shield 10 can alternatively rest on the backing 20 itself in stead of passing there though. When peneration of the pile carrier or backing 20 is not desired the less acute ends 16.2 will naturally be used to perform the support elevating function.

The shield 10 is formed to enable use of both sides of the support 12 as foot supporting seats. As the support 12 is hollow it presents opposite concave and a convex faces. The concave side is normally the preferential side for use in seating a foot 22 as shown in broken lines in FIG. 2. The upward facing parts of the legs 14 perform a boundary defining function in bordering the seating area 12.2 of the support 12 to constrain the foot 22 of an item resting on it, once in use, against undesired dismounting. When the concave side of the support 12 provides the seating area, lateral displacement is thus constrained by both the hollowness of the seating area 12.2 and the border function performed by the appropriate parts of the legs 14.

When a foot is, for example, larger than the seating area 12.2 (as shown in broken lines by reference numeral 22.1 in FIG. 2) it can still make use of the shield 10. This is especially the case when such foot 22.1 is of penetrable material such as wood. In such case, as shown in FIG. 2, the foot 22.1 fully straddles all the appropriate spike ends 16 in response to suitable adjustment of the legs 14. The upward facing spiked ends 16.2 thus penetrate this foot to at least a small extent while the opposite spiked ends 16.1 bear down onto the appropriate support base. To prevent such foot 22.1 from sitting too high above the seating area 12.2 the legs 14 are desirably adjusted along their apertures 18.

The support 12 is also fitted with a foot dismounting counteracting finger 24 fitting screw fashion along a centrally located threaded aperture 26 in the support 12. The opposite ends of the finger 24 are spike shaped to enable penetration of the finger 24 into an appropriate type of foot, as shown in FIG. 2. The finger 24 also serves a dismounting counteracting function when such foot is hollow by simply extending into the interior of such foot. When a foot is however fully solid and of impenetrable material such as metal, the finger 24 is adjusted so that it does not extend above the seating area 12.2.

DESCRIPTION—FIG. 3—Another embodiment of the invention

The further embodiment of the invention, as shown in FIG. 3, is substantially the same as the FIGS. 1 and 2 embodiment. Like references thus carry the same reference numerals. While the spacer in this embodiment is not only used as a carpet shield but also for spacing a foot above a noncarpeted surface, the reference numeral 10 is retained for the shield/spacer of this embodiment.

The difference is found in each leg 14 being spiked at its one end 16 and blunt at its opposite end by ending in a flat faced head 30. The spiked ends 16 are thus used as discussed above. In the case where the spacer 10 is used for spacing a foot above a non-carpeted surface such as a tiled, wooden or cement floor, the legs 14 are inverted to cause the heads 30 to bear against this surface 28.

When so used the spacer 10 will not damage the surface. This is often required where some of the legs of an appropriate article of furniture are situated onto a carpet while some are located onto an uncovered floor adjacent such carpet.

Advantages

The advantages of the present invention thus lie in the spacer accommodating various carpet pile thicknesses as well as a hard support base in the case of furniture partly standing on a carpet and partly on an uncarpeted floor. A further advantage is found in its providing for adjusment to accommodate different leg lengths.

Operation

In use a plurality of shields/spacers 10 are simply located below the feet of an appropriate article of furniture with the legs 14 being preset by way of the spiked ends 16 or end heads 30 for the desired use. The spiked ends 16 thus pass with minimum interference along the piles 32 of a carpet on resting against the carpet backing 20 or even on the floor 28 as penetrating the backing. The legs 14 can be adjusted to ensure that the article is in a stable fashion supported onto the appropriate support base. The finger 24 can be adjusted to penetrate to bottom face of a foot where of penetrable material or protrude into the hollow interior of a foot so formed. If not the case, the finger 24 is adequately withdrawn not to interfere with the seating of a foot. Where one or more of the feet of such article is desired to be spaced above a normally hard support surface adjacent the carpet, these feet are placed on spacers 10 pre-set with their heads 30 facing downward once the spacer 10 is in use thus limiting the damaging of such surface.

What is claimed is:

1. An article of furniture foot spacer for locating a foot of an article of furniture above a support base thereby to enable the desirable maintenance of an article of furniture fitted with a plurality of feet above such base by the use of appropriate number of spacers comprising:

(a) a regularly shaped foot support of adequately firm sheet material to enable its performing a supporting function;

(b) a plurality of spacer legs that fit adjustably along peripherally spaced apertures through the foot support;

(c) said foot support being formed to present convex and concave opposite faces onto a selected one of which a foot of an article of furniture is supportable against undesired dismounting;

(d) at least the convex face of said support presenting a centrally located foot dismounting counteracting finger for foot dismounting counteracting fashion containing a foot supported on this side of the support once the spacer is so used;

(e) said spacer legs being of adequate length to enable effective use of either side of the support in performing an article of furniture foot supporting function; and (f) the coinciding ends on at least one side of said spacer legs ending in spikes of suitable acuteness to enable the foot spacer to in a minimum carpet interference way perform an article of furniture foot spacing function with respect to a support base in the form of a carpet while the sections of the spacer legs facing upward, once the spacer is operatively used, if any and depending on the extent of their lengths required to perform an article of furniture foot spacing function, at least contributing in supporting a foot against undesired dismounting from the support.

2. The spacer recited in claim 1 in which the legs fit fully removably to the support thereby enabling their reversal.

3. The spacer recited in claim 2 in which the legs each presents spiked opposite ends with the acuteness of the spiked ends on the one side being less than on the other side, though the same for all the legs, thus enabling selecting a leg end acuteness depending on a type of carpet pile on which the spacer is intended for use.

4. The spacer recited in claim 3 in which the legs fit adjustably along the apertures by fitting threadably along their apertures.

5. The spacer recited in claim 4 in which the support is generally rectangular in outline shape with the legs fitting thereto towards the outer corners of the support.

6. The spacer recited in claim 5 in which the foot dismounting counteracting finger passes adjustably along the support enabling its use along both faces of the support while enabling at least substantially full retraction from a desired face.

7. The spacer recited in claim 6 in which the foot dismounting counteracting finger end spike shaped at at least one of its ends for also enabling its penetration into the foot of an item permitting such penetration.

8. The spacer recited in claim 2 in which the legs each ends in a spike at one end while being blunt at the opposite end, with the acuteness of the spiked ends being at least substantially the same for all the legs, enabling use of the spacer on a non-carpeted hard support base as well without causing damage thereto, a plurality of spacers as used for a multi-footed article of furniture thus enabling the non-damaging spacing of one or more feet above such non-carpeted surface via the blunt ends of the legs while the other foot or feet are spaced above a carpeted surface via one or more spacers as suitably adjusted with their spiked ends passing into the pile of such carpet.

9. The spacer recited in claim 8 in which the legs fit adjustably along the apertures by fitting threadably along their apertures.

10. The spacer recited in claim 9 in which the support is generally rectangular in outline shape with the legs fitting thereto towards the outer corners of the support.

11. The spacer recited in claim 10 in which the foot dismounting counteracting finger passes adjustably along the support enabling its use along both faces of the support while enabling at least substantially full retraction from a desired face.

12. The spacer recited in claim 11 in which the foot dismounting counteracting finger end spike shaped at at least one of its ends for also enabling its penetration into the foot of an item permitting such penetration.

* * * * *